United States Patent [19]

Anthoine

[11] Patent Number: 4,748,563

[45] Date of Patent: May 31, 1988

[54] HAVE INVENTED CERTAIN NEW AND USEFUL IMPROVEMENTS IN METHOD AND APPARATUS FOR CONTROLLING THE LIFT TRAVEL OF A MAST OR DERRICK

[76] Inventor: Gilles G. Anthoine, 12 Rue Martignon, 92500 Rueil Malmaison, France

[21] Appl. No.: 699,935

[22] Filed: Feb. 8, 1985

[30] Foreign Application Priority Data

Feb. 10, 1984 [FR] France ..... 84 02048

[51] Int. Cl.[4] ..... G06F 15/20

[52] U.S. Cl. ..... 364/420; 73/151; 175/40; 175/52

[58] Field of Search ..... 364/420, 421, 422; 175/24–27, 45, 52; 73/151, 151.5, 152–154

[56] References Cited

U.S. PATENT DOCUMENTS

| | | | |
|---|---|---|---|
| 3,628,025 | 12/1971 | Kieferle | 250/219 |
| 4,110,688 | 8/1978 | Bailey | 73/151.5 |
| 4,134,476 | 1/1979 | Zolnerovitch | 187/29 |
| 4,139,891 | 2/1979 | Sheldon | 364/567 |
| 4,354,233 | 10/1982 | Zhukovsky et al. | 364/420 |
| 4,407,017 | 9/1983 | Zhilikov | 364/420 |
| 4,570,234 | 2/1980 | Baack | 73/151.5 |
| 4,594,665 | 6/1986 | Chandra et al. | 364/422 |
| 4,604,724 | 8/1986 | Shaginian et al. | 364/422 |

FOREIGN PATENT DOCUMENTS

| | | |
|---|---|---|
| 7002540 | 10/1970 | France . |
| 2064623 | 6/1981 | United Kingdom . |

OTHER PUBLICATIONS

The Electronic Engineer, vol. 29, No. 10, Oct. 1970, J. Hickey: "Optoelectronics Part 3A, Application Ideas" pp. 59–63.

*Primary Examiner*—Joseph F. Ruggiero
*Assistant Examiner*—Kimthanh Tbui

[57] ABSTRACT

The invention relates to the automatic control of the lifting travel of a string of pipes suspended from a cable. To stop this string of pipes systematically in a specific position, a first passage check controlled by a sensor, for example sensitive to the rotation of the pulley over which the cable passes, is associated with a second location check controlled by a sensor, for example sensitive to the passage at a given level of the joints separating the pipes two by two.

16 Claims, 3 Drawing Sheets

HAVE INVENTED CERTAIN NEW AND USEFUL IMPROVEMENTS IN METHOD AND APPARATUS FOR CONTROLLING THE LIFT TRAVEL OF A MAST OR DERRICK

The present invention relates, in general terms, to the operations involved in manoeuvring the drill string suspended from a drilling mast or oil rig, particularly as regards the lowering of this drill string.

As is known, a drill string consists essentially of a string of pipes which, variable in terms of their number and length, are connected to one another by screwing, the said pipes for example being equipped at their ends, for this purpose, with joints, commonly called "tool joints", suitable for such screwing, with a drilling tool at the end of the last pipe, and, to manoeuvre the drill string formed in this way the latter is suspended from a pulley or an assembly of pulleys located at the top of a mast or rig, under the control of a control unit comprising a lifting motor and at least one stopping brake, the said control unit driving a winch, on which is wound a cable which, passing over the said pulley or the said assembly of pulleys, carries the drill string, in practice by means of a block-and-tackle device.

As is also known, it is occasionally necessary, during drilling, to extract from a hole the entire drill string located in it, either in order to change its tool if this is worn, or so that it is possible to carry out, on the drill-hole thus exposed and within the latter, any specific operation, such as, for example, an exploration operation or a maintenance operation, and especially the installation of a casing or tubbing.

Of course, once the drill string has been extracted in this way, when drilling resumes it is then reintroduced completely into the drill-hole in question.

In practice, because of the limited height of the drilling mast or oil rig, these operations of extracting or raising and reintroducing or lowering the drill string are carried out by splitting its string of pipes up into successive portions, each composed of a limited number of pipes appropriate for the said height.

The raising or lowering of the drill string has to be stopped each time, in order to carry out, in line with a platform commonly called a drilling platform, after this drill string has been wedged, an operation to separate a new portion of the string of pipes by unscrewing or an operation to fix such a new portion by screwing to reconstruct the assembly as a whole.

The operations implied by such a process, and there are many of them, have conventionally been monitored hitherto visually by an operator who is placed at the controls of the brake or brakes and motor of the control unit.

However, particularly because of the overcrowding of the surrounding area, such an operator is not always as well placed as would be desired to assess precisely the level at which the drill string must be stopped during the manoeuvre, particularly in the upper part of the drilling mast or oil rig, and any feed error on his part, although rare, necessitates at the very least, if it has not already caused any fault or accident moreover, an expensive resumption of the raising or lowering process which prolongs the operations to a corresponding extent, this being detrimental to the productivity of the system as a whole.

Furthermore, even under the best possible circumstances, such an operator can only guarantee that the drill string will stop at a given level to within a few centimetres, approximately ten centimeters on average.

The resulting relative inaccuracy in the position of the drill string in relation to the drilling platform is acceptable when, as occurs in practice, the connected wedging and unscrewing or screwing operations necessary for splitting up or reconstructing this drill string are carried out manually.

However, it makes any mechanisation of such operations difficult, again to the detriment of the productivity of the system as a whole.

Finally, whenever the drill string stops during the manoeuvre, the management of the control unit by means of which this manoeuvre is carried out is, at the present time, left entirely to the judgement of the operator who, for this purpose, usually has at his disposal, in addition to the stopping brake, a band brake which is power-assisted where appropriate, a foot-operated accelerator which makes it possible to act on the motor, and sometimes an electrical retarder, for example an eddy-current or hydraulic retarder, which can be cut in when the need for it arises, for example to save the band brake.

However in practice, because of his position and with the means available to him, the operator cannot, at the present time, evaluate in a sufficiently accurate way the relative distances or altitudes or the raising or lowering speeds of the drill string during the manoeuvre, and this makes it all the more impossible for him to compare them effectively with the available deceleration performances.

He is therefore obliged, for safety reasons, to start deceleration sooner than would perhaps be strictly necessary and end it with a slower approach to the desired final stopping point than would perhaps otherwise be necessary.

This results, in general, in an expensive loss in time, yet again to the detriment of the productivity of the system as a whole.

Moreover, where repetitive operations are concerned, the losses in time, by accumulating, are in the end substantial.

Furthermore, above all, when manoeuvring errors lead, for example, to the available travel being exceeded, a collision inevitably occurs between two components, either, for example, at the top of the drilling mast or oil rig, between the two blocks constituting the block-and-tackle device from which the drill string is suspended, or, at the level of the drilling platform, between the lower of these blocks and this drilling platform, and this collision can be sufficiently violent to result in damage to the components subject to it, and even in a fracture of these, to the detriment of the safety of the surrounding personnel, the useful life of the equipment and the good conditiqn of the drill-hole.

In practice, excessively costly checking and repair operations are then usually necessary.

To achieve a greater degree of safety and ensure higher profitability, it is therefore desirable to adopt automatic control of the travel of the drill string, called the lifting travel here simply for the sake of convenience, whether a raising travel or a lowering travel is concerned.

Such a travel control is already known in related sectors, such as, for example, that of upward and downward conveyors.

It conventionally implies the use of monitoring means, such as sensors, at the exact level of the stops desired, for example in conjunction with a reference mark or marks on the moving device to be stopped.

In this particular case, the only reference marks available on a drill string are the "tool joints", or joints between pipes, which punctuate it in places, their diameter being slightly greater than that of the pipes which they connect.

It is not possible to use on the drilling platform itself monitoring means designed for detecting these "tool joints", since this drilling platform has to be completely free, particularly to ensure that the wedging and unscrewing or screwing operations briefly mentioned above are carried out smoothly.

It is likewise impossible to place such monitoring means underneath the drilling platform, on the one hand because there is no available space there either, and on the other hand because such a location, being subjected to splashes of mud in particular, is not favourable for such a installation.

Finally, placing these monitoring means above the drilling platform would at best only solve the problem during lowering and not during raising.

It is also possible to consider using such monitoring means at a greater height, for example at the top of the drilling mast or oil rig, subjecting them to the complete passage of the drill string.

However, in this case, the inevitable slipping of the cable on the pulley, the elongation of this cable according to the highly variable load suspended from it and both the elongation of the pipes constituting this load and the varied compression of the drilling mast or oil rig from which it is suspended are so many factors which, when poorly controlled, are liable to produce a discrepancy between the stopping distance estimated on the basis of height monitoring carried out in this way and that actually to be adhered to at the level of the drilling platform, and as a result of drift accumulating from one operation to another such a discrepancy can quickly become prohibitive.

The subject of the present invention is, in general terms, a process designed to allow effective automatic-control of the lifting travel on a drilling mast or oil rig, whilst at the same time overcoming the disadvantages briefly discussed above and also resulting in other advantages; another of its subjects is an apparatus designed for carrying out this process.

According to the invention, to stop the string of pipes systematically, during the manoeuvre, in a position in which two specific pipes of the latter have their joint located at a specific level above the drilling platform, a first check, called a passage check here simply for the sake of convenience, aimed at the complete passage of the said string of pipes, is associated with a second check, called a location check here simply for the sake of convenience, which, aimed at the presence in turn of the joints between pipes in line with a given reference mark, is designed to make it possible, when such a joint passes in line with the said reference mark, to reset the passage check, and action is consequently taken on the control unit.

In practice, the sensor, or passage sensor, used for the passage check is capable of ensuring the desired control in general terms, whilst the sensor, or location sensor (used jointly to carry out the associated location check) is activated only from time to time, preferably at each passage of a joint between pipes, to make this control more accurate.

Because the passage check is systematically reset in this way, any drift is avoided.

All that may perhaps remain each time, without any accumulation being possible, is the offset which can result from the slipping, elongation, compression or the like occuring in a time interval corresponding to the passage of the string of pipes over a distance equal to that separating the location sensor from the drilling platform.

However, this distance can be relatively reduced, whilst at the same time avoiding any influence exerted by this location sensor on the drilling platform and any interference by it with the personnel and/or equipment moving around on the latter.

In practice, the location sensor can thus be installed only a few meters above the drilling platform.

Consequently, a high degree of accuracy can be obtained as regards the stopping level of the drill string, and this accuracy can, for example, be of the order of one centimeter and in any case is sufficient to allow the possible use of mechanised means.

However, the apparatus according to the invention also makes it possible, in complete safety, to achieve an advantageous optimisation of decelerations.

Productivity and the safety of personnel benefit from this.

Moreover, if desired, the apparatus according to the invention also makes it possible-to manage the actual drilling operation.

As is known, this is conventionally carried out by the progressive lowering of the drill string as a function of the movement of the suspended load, this movement being a mirror image of the progress of the working face.

Instead of being carried out manually, this progressive lowering of the drill string can be controlled automatically by the apparatus according to the invention which then incorporates for this purpose, and moreover for safety reasons, a sensor sensitive to the suspended load.

Consequently, the apparatus according to the invention is designed for optional management of all the activities involved in a drilling operation.

It is also advantageously capable not only of equipping in advance future drilling masts or oil rigs, but also of being attached to those already in existence, without appreciably disturbing the operating conditions of these.

Morereover, the characteristics and advantages of the invention will emerge from the following description given by way of example, with reference to the attached diagrammatic drawings in which.

Figure 1:
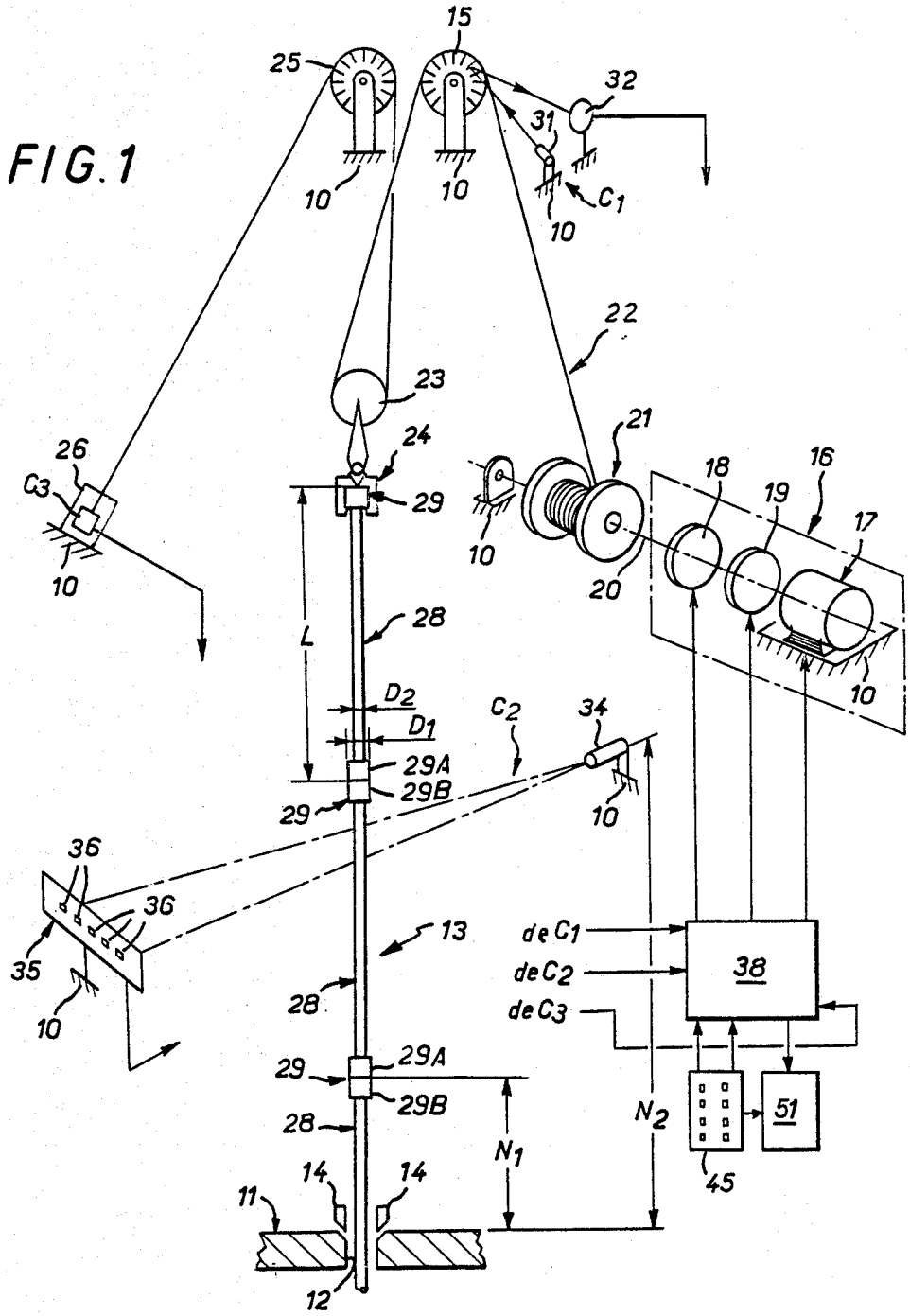
FIG. 1 is a partial diagrammatic view in elevation or in perspective of those components of a drilling mast or oil rig to which the present invention relates.

In FIG. 1, the same general reference numeral 10 indiscriminately indicates various elements of the superstructure of the drilling mast or oil rig in question, without this being shown in detail.

In fact, this superstructure is well known per se and as such does not form part of the present invention.

FIG. 1 shows partly individually only the platform 11 of the superstructure in question, commonly called the drilling platform.

As is known, such a drilling platform 11 has locally a recess 12 intended for the passage of a drill string 13, and in association with this recess 12 there are, as indicated in FIG. 1, wedges 14 which, during the manipulations of the drill string 13, are designed to lock the latter in position or wedge it simply by means of jamming in relation to the drilling platform 11, for the momentary suspension of this drill string 13 from the latter.

As is also known, alternating with such a suspension, the drill string 13 can likewise be suspended from a pulley or assembly of pulleys 15 mounted rotatably in the upper part of the drilling mast or oil rig under the control of a control unit 16 comprising a lifting motor 17, at least one stopping brake 18 and servo-mechanisms suitable for controlling such a motor and such a brake (these are not shown in the figure).

In practice, two stopping brakes 18, 19 are conventionally provided, the first being a band brake and the second an electrical or hydraulic retarder.

At all events, this stopping brake or these stopping brakes 18, 19 act on a shaft 20, on which the shaft of the motor 17 is wedged, with a speed reducer being interposed if appropriate, and on which is also wedged a lifting winch 21 with a cable 22 designed for suspending th drill string 13.

For example, as illustrated, the cable 22 first passes over the pulley 15 and then over a block-and-tackle deVice 23, from which is suspended a hoist 24 designed to grasp the drill string 13, before passing over a guide pulley or guide-pulley assembly 25 and finally being coupled to an anchoring block 26 fixed to the superstructure 10 of the drilling mast or oil rig.

For the sake of greater simplicity, only one pulley 15 is envisaged here, the same being true of the guide pulley 25.

However, in actual fact, several pulleys, for example five or six, are used each time.

Finally, as is known, the drill string 13 to be manipulated consists essentially of a plurality of drill pipes 28 placed end to end in succession, with a drill tool (not shown) at the end of these, these drilling pipes 28 each possessing, to fix them to one another two by two, two matching end pieces 29A, 29B, one male and the other female, which are each arranged respectively at each of their ends and which are intended to be screwed to one another.

When they are engaged with one another, such end pieces 29A, 29B together form what is conventionally called a joint between pipes 29, or more specifically a "tool joint".

In practice, such a joint 29 has transversely a diameter D1 plainly greater than that D2 of the pipes 28.

The number of pipes 28 of which the drill string 13 consists varies depending on the depth of the drill-hole.

Furthermore, the length L of a pipe 28, measured from one of its end pieces 29A, 29B to the other, can likewise vary from one pipe 28 to another, although it is in the region of an average value which is usually of the order of 9 m or more rarely 13 m.

Since the height of the drilling mast or oil rig is limited, to manoeuvre the drill string 13 the latter needs to be split up into successive portions comprising only a limited number of pipes 28 which is usually equal to three or more rarely, when their length is of the order of 13 m, two.

If the extraction of a drill string 13 having pipes 28 with a length of the order of 9 m is taken as an example, it is necessary each time, the operations being deliberately indicated diagrammatically for greater simplicity, to extract three successive drill pipes 28 from the drill-hole and, after the lifting winch 21 has been stopped, to place the wedges 14 under the upper end piece 29B of the fourth drill pipe 28, before it becomes possible to separate from the latter by unscrewing the three drill pipes 28 located above it, then to place on one side on the drilling platform 11 the portion of drill string 13 detached in this way from the running part of the latter, and finally, with the hoist 24 being released, to bring this hoist 24 back to the level of the drilling platform 11 to allow it to grasp a new portion of drill string 13.

In the case of reintroducing the drill string 13 into the drill-hole, it is necessary to carry out operations which are the reverse of the preceding ones.

Each time, the string of pipes must be stopped systematically in a position in which two pipes 28 have or are capable of having their common joint 29 at a specific level N1 above the drilling platform 11, whether the separation of such a joint 29 is to be carried out during raising or, on the contrary, whether it is to be reconstructed during lowering, the said level N1 being taken, for example, at the interface between the two end pieces 29A, 29B constituting it, as illustrated.

And each time, it is consequently necessary to ensure the to-and-fro movement of the hoist 24, moreover with complementary engagement or disengagement travels for the latter.

According to the invention, to ensure such systematic stopping of the string of pipes of the drill string 13, a first check, called a passage check simply for the sake of convenience, aimed at the complete passage of this string of pipes, is associated with a second check, called a location check simply for the sake of convenience, which, aimed at the presence in turn of the joints 29 in line with a given reference mark, is designed to make it possible, when a joint 29 passes in line with such a reference mark, to reset the passage check, action consequently being taken on the control unit 16.

In practice, for the passage check, a first sensor C1, or passage sensor, is used, and this, being sensitive to the complete passage of the string of pipes of the drill string 13 during handling, is designed to carry out the desired control in general terms.

For example, as illustrated, this sensor C1 located in the upper part of the drilling mast or oil rig is designed to detect the rotation of the pulley 15 which, for example, possesses for this purpose, in a conventional way, a series of notches uniformly distributed over one of its flanks, the sensor C1 incorporating a transmitter 31 and a receiver 32 which are intended for detecting such notches by means of reflection.

However, other types of detection are possible, of course, for example by means of marking and optical or magnetic reading or even by means of a pulse transmitter or electrical shaft.

Alternatively, it is also possible to measure by means of a suitable sensor C1 the distance which vertically separates a fixed reference level and any component connected in terms of movement to the drill string 13, for example the block-and-tackle device 23.

The advantage of such an arrangement, which therefore involves wedging the passage sensor on the hoist 24, is that it makes it possible to eliminate the causes of error occurring upstream, particularly those attributed to possible slipping of the cable 22 on the pulley 15, and consequently to minimise the deviations to be corrected.

In practice, however, the passage sensor C1 to be used can take effect at any point on the kinematic chain extending from the lifting winch 21 to the hoist 24.

At all events, in the first instance, there is overall proportionality between the signal supplied by such a passage sensor C1 and the linear displacement of the drill string 13, and it is along these lines that this passage sensor C1 is thus capable of ensuring the desired control in general terms.

In conjunction with this, for the location check pro-Vided according to the invention, a second sensor C2, or location sensor, is used, and this, being sensitive to the presence in turn of the joints 29 in line with a given reference mark formed by itself, is designed to reset from time to time the signal supplied by the passage sensor C1, to make the desired control more accurate.

In practice, this location sensor C2 is installed at a level N2 relative to the drilling platform 11 which is separate from the desired stopping level N1 and higher than this.

In practice, this level N2 is of the order of several meters, for example five, so that the location sensor C2 in no way interferes with the immediate surroundings of the drilling platform 11 and is completely protected from the personnel or equipment moving about on the latter.

As illustrated, the location sensor C2 can comprise a transmitter 34 and a receiver 35 which are each arranged respectively on either side of the passage zone of the drill string 13 at the level N2.

For example, the transmitter 34 can consist of a light source, and the receiver 35 can consist of a battery of photo electric cells 36 arranged horizontally in a line at regular intervals.

In such a case, the desired detection is carried out by discriminating between the number n1 of photo electric cells masked by the running part of the drill pipes 28 and the number n2 of those photo electric cells which are masked by their joints 29.

This discrimination is preferably performed at the base of the joints 29, the location sensor C2 being positioned accordingly.

Finally, in the embodiment illustrated, a third sensor C3, or load sensor, is provided for monitoring the load suspended from the block-and-tackle device 23.

This can be, for example, a strain gauge which, being sensitive to the tension of the slack side of the cable 22, is arranged in the block 26 cnsuring that the latter is coupled to the superstructure 10 of the drilling mast or oil rig.

It can also be a hydraulic cell in which the pressure is assessed.

Where a strain gauge is concerned, this can alternatively act on the shaft of one of the pulleys used or, in a more general way, in any place sensitive to the weight of the system as a whole.

Moreover, the control apparatus according to the invention incorporates a central processing unit 38, in which a comparator 39 receives at its inputs the duly processed signals supplied by the passage sensor C1 and the location sensor C2.

Figure 2:
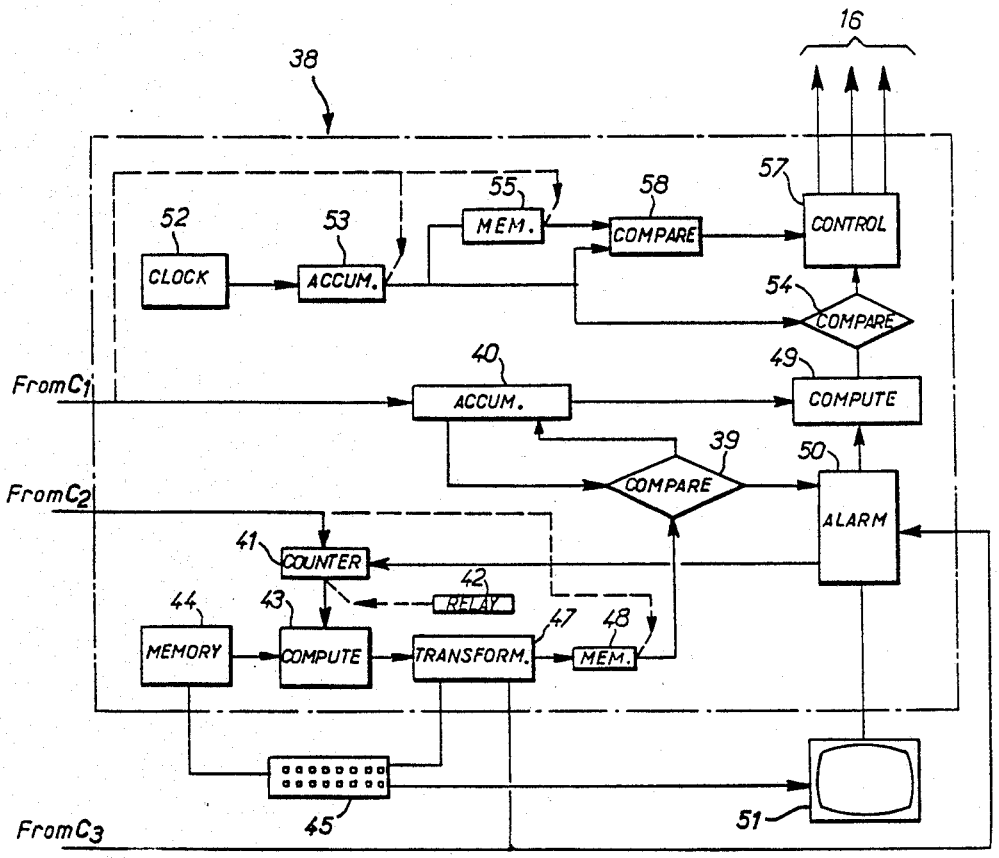
FIG. 2 is a block diagram of a central control unit designed to put the present invention into practice.

The block diagram in FIG. 2 indicates in a conventional way by solid strokes the lines corresponding directly to the signals in question and by dot-and-dash strokes those corresponding to the related transfer instructions and to the necessary zero resetting.

In practice, the signal supplied by the passage sensor C1 consists of a succession of pips, or passage pips, the interval between which is proportional to a specific length, for example of the order of 3 mm.

When the signal is entered in the central processing unit 38, it is applied to a decremental accumulator 40, that is to say to a device which, initialised at the outset by the distance to be covered between two stops to be observed, assesses, in terms of the number of pips subtracted systematically pip by pip from the number of pips with which it was initially loaded in this way, the pips constituting the signal which it receives from the passage sensor C1.

As a corollary to this, the signal supplied by the location sensor C2, which itself consists, in practice, of a succession of pips, or location pips, in principle one for each joint 29 detected, is applied to a counter 41.

At the appropriate time, a time-delay device 42 transfers the content of this counter 41 to a computation unit 43 which, as a function of the data present in a memory 44, the data having been entered in the memory 44 by means of a keyboard 45 at the operator's disposal, and being such as lengths of pipes in movement, order of succession of these, stopping program or number of pipes to be adhered to between each stop to be controlled, and the like, prepares in terms of numbers of passage pips, at each passage of a joint 29, the distance normally remaining to be covered before the joint 29, in line with which a stop is in fact to be ensured.

The number of passage pips calculated in this way is applied to a transformer 47 which improves it as a function of the signal which it receives from the load sensor C3, and consequently as a function of the value of the load suspended from the block-and-tackle device 23, on the one hand, and as a function of correcting parameters, such as the outside temperature or the like, which have also been entered by means of the keyboard 45 or specific external sensors, on the other hand.

At the start of each manoeuvre, the number of passage pips calculated and corrected in this way and then corresponding to the total distance to be covered is applied to the incremental accumulator 40 in order to initialise the latter as required.

Furthermore, at each location pip, it is applied to a memory 48, before being presented at one of the inputs to the comparator 39, the corresponding transfer instruction being initiated by the location pip immediately following that which initiated the preceding calculation.

As will be noted, the computation of the number of passage pips normally to be adhered to before the next stop to be ensured is thus conveniently carried out with an amply sufficient margin of time, since this corresponds to the time interval separating two location pips and since these are spaced considerably from one another.

Each passage pip of the signal supplied by the passage sensor normally controls the transfer of the content of the decremental accumulator 40 to a computation unit 49 designed to prepare, as a function of this passage pip and of a predetermined law laid down at the outset, the speed which is desirable for the control unit 16 to maintain.

The comparator 39 which therefore receives at its inputs two numbers of passage pips, one assessed directly on the basis of the signal supplied by the passage sensor C1 and the other computed and corrected, at each passage of a joint 29, on the basis of the signal supplied by the location sensor C2, compares these two numbers, and if these two numbers are equal at the moment of this comparison controlled by a location pip attributed to a joint 29 there is in fact a transfer of the content of the decremental accumulator 40 to the computation unit 49.

If, on the other hand, at the moment of comparison the two numbers of location pips received at its inputs by the comparator 39 are not equal, and if they differ from on another only with a deviation less than a given deviation considered to be acceptable, the comparator 39 supplies to the decremental accumulator 40 a resetting signal which, in practice, consists of that of the numbers which it received from the memory 48, this therefore being the computed and corrected number of passage pips, to substitute this for the content of the decremental accumulator 40, and it is this computed and corrected number of passage pips which is then addressed to the speed computation unit 49.

In other words, the value in place in the decremental accumulator 40 is then modified, being corrected by the value of the difference computed by the comparator 39.

As will be noted, the resetting carried out in this way occurs at most only at each location pip taken into account.

If the deviation between the two computed and measured numbers of passage pips received by the comparator 39 is greater than the deviation considered to be acceptable, the comparator 3 actuates an alarm unit 50 which, designed to trip an alarm where appropriate, also controls the speed computation unit 49, to trigger a special emergency stopping procedure.

For the same purpose, it also receives the signal supplied by the load sensor C3.

This alarm unit 50 likewise controls the counter 41 to invalidate a location pip as the occasion arises.

Although this is desirable to limit the possible deviations, it is not in fact necessary for the possible resetting of the decremental accumulator 40 to take effect systematically at each of the location pips; in practice, it is sufficient for it to take effect at at least some of these.

In the embodiment illustrated, the alarm unit 50 finally controls a display unit 51, also enabling the operator to monitor the data which he enters in the central processing unit 38 by means of the keyboard 45.

Moreover, the central processing unit 38 also incorporates a clock 52, the signals of which are applied to an accumulator 53.

At each passage pip, the content of the latter, which then represents the actual speed of the drill string 13 during the manoeuvre, is applied, with accompanying zero resetting, on the one hand to a speed comparator 54, which also receives the desired speed prepared by the speed computation unit 49, and on the other hand to a memory 55.

At each passage pip, the speed signal formed by the content of the latter is applied in turn, but delayed one passage pip, to a comparator 56 which, likewise receiving the speed signal which is the instantaneous content of the accumulator 53 at the passage pip in progress, supplies a signal which represents either the acceleration or deceleration of the drill string 13 during the manoeuvre.

This signal and that supplied by the speed comparator 54 are applied to a control block 57 intended for the desired control of the control unit 16, this control block 57 being designed to define, as a function of the signals which it receives, such control signals as to ensure control and stable operation of the servomechanisms of the said control unit 16.

Figure 3:
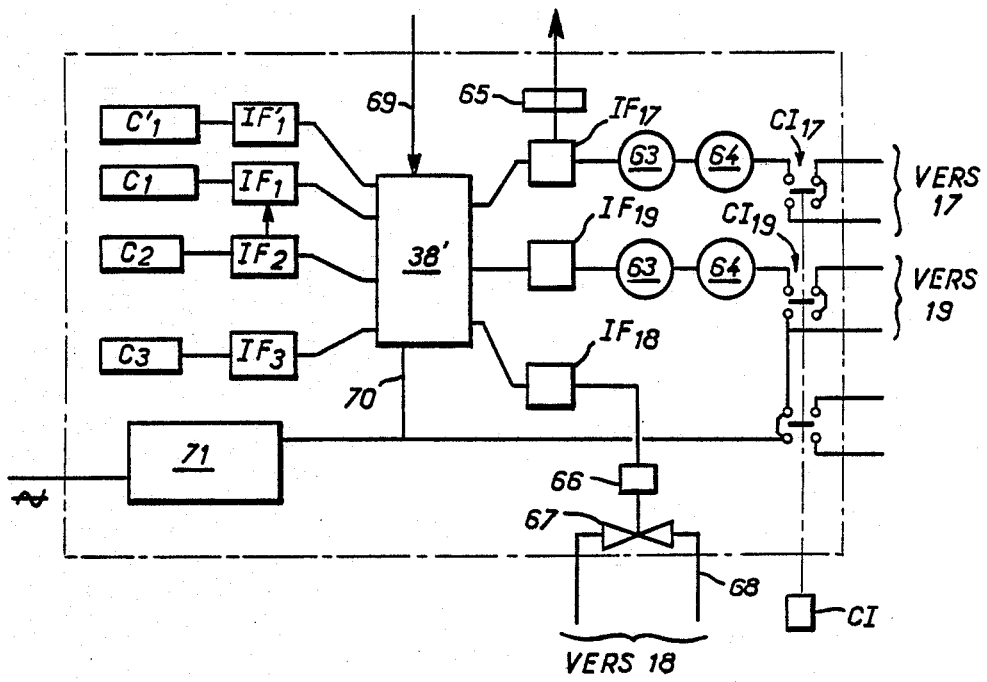
FIG. 3 is a general diagram illustrating an alternative embodiment.

In the alternative embodiment illustrated in the diagram of FIG. 3, the central processing unit 38' used assumes, in general, only the functions of the following components mentioned above: the comparator 39, the counter 41, the computation unit 43, the memory 44, the transformer 47, the computation unit 49, the alarm unit 50, the speed comparator 54 and the control block 57.

In contrast, in the embodiment illustrated, it also incorporates the keyboard 45 and the display unit 51.

As a corollary to this, an interface IF1, IF2, IF3 respectively is interposed between each sensor C1, C2 and this central processing unit, and the interface IF1 thus associated with the passage sensor C1 incorporates the functions previously performed by the clock 52, the accumulator 53, the memory 55 and the comparator 56 and to a certain extent, as will emerge below, that performed previously by the accumulator.

In other words, the interface IF1 is designed to accumulate the passage pips and consequently compute, by means of successive derivations, the actual speed of the drill string 13 during the manoeuvre and its acceleration.

However, in contrast to the preceding accumulator 40, the accumulator which it thus constitutes in one of its functions is not decremental, this accumulator being neither updated nor corrected.

In practice, to increase the reliability of the apparatus, the passage sensor C1 is duplicated.

In other words, two passage sensors C1, C'1 are used, with their respective interfaces IF1, IF'1, and if the information supplied by these two passage sensors C1, C'1 shows a difference greater than a predetermined value an emergency stop is commanded.

Figure 4:
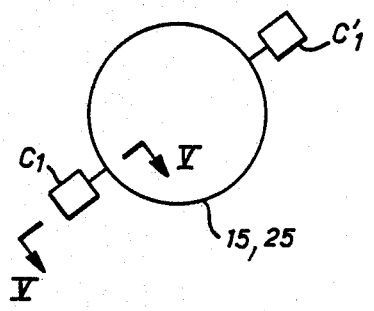
FIG. 4 is an elevation view illustrating part of this alternation embodiment.

For example, as illustrated diagrammatically in FIG. 4, the two passage sensors C1 C'1 used in this way can be located in positions substantially diametrically opposite one another in relation to one and the same pulley 15 or 25.

Figure 5:
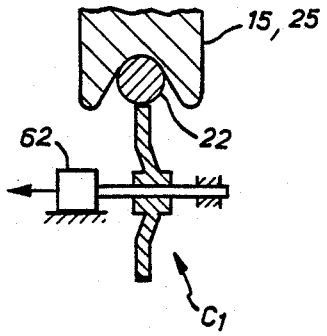
FIG. 5 is a partial sectional view along the line V—V of FIG. 4.

As an alternative to the preceding arrangements, there can be for one of them each time, as illustrated diagrammatically in FIG. 5, a wheel which is mounted rotatably in contact with the cable 22 by means of its edge and which via its axle, on which is wedged for this purpose a graduated disc not visible in the figure, controls a Hall-effect sensor 62.

Such a passage sensor C1 C'1 is capable of detecting the direction of passage of the drilling cable 22 and supplies passage pips in a number proportional to the displacement of this cable.

For example, a passage pip is thus transmitted at least for each 10 mm of peripheral development of the corresponding pulley, associated with a peripheral speed of the latter of 1 m/s.

As before, the joints 29 are detected by optical means.

However, as an alternative to the preceding arrangements, for this purpose, a point transmitter and a linear receiver are no longer used, but a linear transmitter, but a linear transmitter, (sic) in practice a fluorescent tube, and a point receiver, in practice a commercial linear television camera, that is to say one with a single line, for carrying out an analysis which is thus akin to pattern recognition.

In practice, as before, the width of the shadow cast by the joints 29 is detected, thus making it possible to dispense with the precise positioning of the drill string 13 transversely in relation to its axis.

Also as before, the desired discrimination is carried out at the base of the joint 29.

As illustrated in FIG. 3, the central processing unit 38' controls by means of interfaces IF17, IF18 and IF19 the lifting motor 17, the band brake 18 and the retarder 19.

As regards the lifting motor 17 and the retarder 19, this action takes place by means of a stepping motor 63 and a potentiometer 64, as well as by means of a change-over contact CI17, CI19 designed to pass from manual control to automatic control under the command of a control CI at the operator's disposal.

The interface IF17 associated with the lifting motor 17 also controls, by means of a relay 65, a compressed air valve designed for monitoring the corresponding engagement.

As regards the band brake 18, the corresponding interface IF18 in fact controls, by means of a relay 66, a servo-valve 67 interposed in the hydraulic supply circuit 68 of the corresponding jack.

At 69, the central processing unit receives the emergency stop instructions, and at 70 receives its supply from the protection and supply block 71 itself served by the mains.

At each location pip, the interface IF2 associated with the location sensor C2 causes the storage of the instantaneous value of the accumulator which the interfaces IF1, IF'1 associated with the passage sensors C1 C'1 possess, this value being proportional to the attitude of the drill string 13 during manipulation at the time when the corresponding point 29 of the latter passes.

In practice, the central processing unit 38' works in successive loops of a duration of the order of, for example, 0.01 seconds.

At each loop, it systematically interrogates the various interfaces IF1, IF'1, IF2, IF3, searching in the interfaces IF1, IF'1 for the instantaneous value of the corresponding accumulator, in the interface IF2 for the suspended-weight value supplied by the sensor C3 and in the interface IF2 for the location pip accompanying the passage of a joint 29.

On the basis of the latter, it assesses whether it is acceptable by comparison with a range of precalculated values.

If this is the case, it consequently corrects the vertical distance to be covered, where necessary.

Otherwise, it does not make such a correction.

Likewise, at each loop, the central processing unit 38' compares with a range of precalculated values the suspended-weight value present in the interface IF3 associated with the sensor C3 and consequently actuates the band brake 18 and/or the retarder 19, either to stop the manoeuvre or to correct the suspended-weight value where automatic drilling is concerned.

In the foregoing, the various components used are in practice defined by their function. Their practical production, which moreover may vary greatly, comes within the scope of a person skilled in the art and therefore will not be described here.

In practice, several stopping program can be envisaged for the control unit 16, each corresponding to different laws of deceleration.

Thus, there can be provided emergency deceleration, a standard optimum deceleration and a safety deceleration, depending on the conditions observed.

In all cases, the lowering speed of the drill string 13 can be limited, either for reasons related to the drilling mast or oil rig, and taking into account the performances of its various components, such as, for example, more specifically its lifting winch 21, or for external reasons, such as the possible swabbing of the drill string 13 in the drill-hole in progress.

Preferably, the various components used are organised in such a way that, in the event of a failure of any one of them, the control unit 16 is stopped systematically.

Furthermore, for safety reasons, but in an optional way, the various sensors used can themselves be duplicated.

Finally, arrangements are made to establish a bypass momentarily in relation to a sensor supplying a signal which is obviously incorrect, by replacing the latter with a value extrapolated from its preceding value, and, should the disturbance recorded in this way persist, to either trigger an alarm or stop the control unit 16 systematically.

For example, it is not essential that the location sensor should in fact supply a location pip at the passage of each of the joints 29, since its action could is (sic) disturbed by the presence of a foreign element or foreign elements in line with such a joint 29.

As already indicated above, it is in fact sufficient, for the desired resetting of the signal supplied by the passage sensor, that it should from time to time supply a signal intended for such resetting.

Moreover, the present invention is not limited to the embodiments described and illustrated, but embraces any alternative form.

I claim:

1. A method for the automatic control of the lifting travel of an apparatus of a drilling mast and oil rig type including a platform on which a string of pipes variable in number of pipes and in length of individual pipes is suspended from a pulley under the control of a contorl unit, said control unit comprising a lifting motor and a stopping brake for positioning the strip of pipes in a position in which a joint between two specific pipes is at a specific level above the platform; the method comprising the steps of obtaining and storing data including order of succession, number and length of the pipes defining the string of pipes, said obtained and stored data being of sufficient accurracy to provide for a rough control of the positioning of a selected pipe joint of the string of pipes at a preselected height above the platform, monitoring the movement of the string of pipes and monitoring the presence in succession of joints between the pipes of the string of pipes in alignment with respect to a given reference mark, comparing an actual position of a monitored joint between pipes with the stored data, correcting the stored data as a function of the actual position of the monitored joint, and operating the control unit utilizing the corrected data to position a selected joint of the string of pipes at the preselected height above the platform.

2. Apparatus for the automatic control of a lifting operation on a mechanism of a drilling mast and oil ring type including a platform and a hoist, said hoist being suspended from a pulley and having suspended therefrom a string of pipes variable in number and length, said apparatus comprising a lifting motor and a stopping brake connected to said hoist for positioning the string of pipes in a position in which a joint between two specific pipes of the string of pipes is at a preselected level above said drilling platform, and a control unit for controlling the operation of said lifting motor and stopping means to automatically effect said joint positioning, said control unit including a memory for storing data including order of succession of the pipes in the string of pipes, number of pipes and length of each pipe defining the string, a passage sensor and a location sensor coupled to said memory, said passage sensor being sensitive to the passing of the entire string of pipes during the lowering of the string and said location sensor being sensitive to the presence in succession of joints between adjacent pipes in the string when each joint is in alignment with a preselected reference mark, said passage sensor and said location sensor in combination providing data to said memory to provide a rough control of the positioning of pipe joints at said preselected level, and correcting means coupled to said control unit for intermittently supplying a correcting signal to said memory to update information as to pipe joint location stored in said memory to make the positioning of pipe joints at said preselected level more arcuate, said correcting signal being a signal supplied by the passage sensor as a function of a signal supplied by the locating sensor.

3. An apparatus as claimed in claim 2, wherein the location sensor is arranged a few meters above the platform.

4. An apparatus according to claim 2, wherein said correcting means comprises means for processing output signals supplied by the passage sensor and the location sensor, a comparator having inputs for receiving duly processed output signals from the passage sensor and location sensor, said comparator having an output for controlling a decremental accumulator, said decremental accumulator being connected to receive duly processed output signals from the passage sensor for modification of the content of said decremental accumulator by the value of the difference between the duly processed output signals supplied by the passage sensor and the location sensor, a speed computation unit, and means for transferring any modified content of the decremental accumulator to said speed computation unit under the control of the duly processed output signals from the passage sensor.

5. An apparatus as claimed in claim 2, wherein said correcting means includes means for processing output signals supplied by the location sensor, said means for processing being under the control of said memory.

6. An apparatus as claimed in claim 2, wherein said correcting means includes an interface for accumulating output signals supplied by the passage sensor, said interface being adapted to compute by successive derivations the speed and acceleration of the string of pipes, said correcting means further includes an interface associated with the location sensor, and a central processing unit including said memory and having means operative in successive cycles to systematically interrogate said interfaces in each of the cycles.

7. An apparatus as claimed in claim 2, wherein said location sensor comprises a battery of horizontally aligned, regularly spaced photoelectric cells for discriminating between the number of the cells masked by portions of the pipes between the joints and the number of cells masked by the joints themselves.

8. An apparatus as claimed in claim 4, further comprising means for deriving a speed signal from the output signals from the passage sensor including a clock, a speed comparator having an input connected to receive an output signal delived by said speed computation unit and another input connected to receive the speed signal, and a control block for controlling the control unit, said control block having an input connected to said speed comparator for control by said speed comparator.

9. An apparatus according to claim 4, wherein said means for processing the output signals supplied by the location sensor comprises a transformer controlled by a third sensor responsive to a load to which the hoist is subjected in executing the maneuver of the string of pipes.

10. An apparatus according to claim 4, wherein an alarm unit is connected to an output of said comparator and an input of the speed computation unit and is adapted to be triggered in response to a value of the difference between the duly processed output signals from the passage sensor and the location sensor greater than a predetermined differential.

11. An apparatus as claimed in claim 6, wherein said central processing unit has means for assessing whether each pip of the signal supplied by the location sensor is acceptable by comparison with a range of precalculated values and for determining, if the pip is acceptable, any necessary further displacement of the string of pipes.

12. An apparatus as claimed in claim 6, further comprising a third sensor sensitive to a load to which the hoist is subjected in executing the maneuver of the string of pipes, and an interface associated with the third sensor interrogated during each cycle.

13. An apparatus as claimed in claim 7, wherein the location sensor is located so that the desired discrimination is performed at the base of the joints between the pipes.

14. An apparatus as claimed in claim 8, wherein a third comparator has an output connected to the control block, said third comparator having an input for receiving the speed signal from the means for deriving the speed signal and an input for receiving a delayed speed signal.

15. An apparatus according to claim 9, wherein an alarm unit is connected to an output of the comparator and an input of the speed computation unit and is adapted to be triggered in response to a value of the diffrence between the duly processed output signals from the passage sensor and the location sensor greater than a predetermned differential.

16. An apparatus according to claim 15, wherein the alarm unit is responsive to an output signal from the third sensor.

* * * * *